US011859318B2

(12) United States Patent
Josefsson et al.

(10) Patent No.: US 11,859,318 B2
(45) Date of Patent: Jan. 2, 2024

(54) YARN FEEDING DEVICE WITH LEARNING PROCEDURE

(71) Applicant: VANDEWIELE SWEDEN AB, Ulricehamn (SE)

(72) Inventors: Pär Josefsson, Borås (SE); Birger Johansson, Tvärred (SE)

(73) Assignee: VANDEWIELE SWEDEN AB, Ulricehamn (SE)

( * ) Notice: Subject to any disclaimer, the term of this patent is extended or adjusted under 35 U.S.C. 154(b) by 406 days.

(21) Appl. No.: 17/286,039

(22) PCT Filed: Oct. 14, 2019

(86) PCT No.: PCT/SE2019/051004
§ 371 (c)(1),
(2) Date: Apr. 16, 2021

(87) PCT Pub. No.: WO2020/080996
PCT Pub. Date: Apr. 23, 2020

(65) Prior Publication Data

US 2021/0388544 A1 Dec. 16, 2021

(30) Foreign Application Priority Data

Oct. 18, 2018 (SE) ..... 1851278-0

(51) Int. Cl.
*D03D 47/36* (2006.01)
*B65H 59/38* (2006.01)

(52) U.S. Cl.
CPC ..... *D03D 47/36* (2013.01); *B65H 59/38* (2013.01); *B65H 2701/31* (2013.01)

(58) Field of Classification Search
CPC .... D03D 47/36; D03D 47/369; D03D 51/007; D03D 51/005; D03D 47/345; B65H 59/38; B65H 51/30; B65H 59/387; B65H 59/388
(Continued)

(56) References Cited

U.S. PATENT DOCUMENTS 5,313,988 A * 5/1994 Bilcke ..... D03D 51/007 388/930
5,321,621 A * 6/1994 Sainen ..... D03D 51/007 139/1 R
(Continued)

FOREIGN PATENT DOCUMENTS

CN 108290699 7/2018
EP 0 548 185 6/1993
(Continued)

OTHER PUBLICATIONS

International Search Report for PCT/SE2019/051004, dated Nov. 26, 2019, 5 pages.
(Continued)

*Primary Examiner* — Clinton T Ostrup
*Assistant Examiner* — Brianna T. Duckworth
(74) *Attorney, Agent, or Firm* — NIXON & VANDERHYE P.C.

(57) ABSTRACT

Described are, among other things, methods and devices for providing a learning procedure in a yarn feeding arrangement (12). The learning procedure aims at providing control data to the controller (32) about system components and behavior of system components of the yarn feeding arrangement beforehand, such that the controller has knowledge of the system components before the weaving machine (10) is started to operate at full operational speed.

16 Claims, 4 Drawing Sheets

(58) Field of Classification Search
USPC ..... 139/450; 700/140
See application file for complete search history.

(56) References Cited

U.S. PATENT DOCUMENTS

| | | | | |
|---|---|---|---|---|
| 5,417,251 | A | 5/1995 | Josefsson et al. | |
| 5,613,528 | A | 3/1997 | Zenoni et al. | |
| 6,976,511 | B2 * | 12/2005 | Covelli ..... | D03D 47/367 139/452 |
| 2003/0145899 | A1 | 8/2003 | Covelli | |

FOREIGN PATENT DOCUMENTS

| | | | | |
|---|---|---|---|---|
| EP | 0 713 838 | | 5/1996 | |
| EP | 1544339 | | 6/2005 | |
| EP | 3374303 | | 9/2018 | |
| JP | 2003-530493 | | 10/2003 | |
| WO | 2017/081711 | | 5/2017 | |
| WO | 2017081711 | | 5/2017 | |
| WO | WO-2017081711 | A1 * | 5/2017 | ..... B65H 51/20 |
| WO | 2018/013033 | | 1/2018 | |
| WO | 2018/051378 | | 3/2018 | |

OTHER PUBLICATIONS

Written Opinion of the ISA for PCT/SE2019/051004, dated Nov. 26, 2019, 6 pages.
European Search Report for EP Application No. 19873415 dated Oct. 19, 2021, 1 page.

* cited by examiner

YARN FEEDING DEVICE WITH LEARNING PROCEDURE

This application is the U.S. national phase of International Application No. PCT/SE2019/051004 filed 14 Oct. 2019, which designated the U.S. and claims priority to SE Patent Application No. 1851278-0 filed 18 Oct. 2018, the entire contents of each of which are hereby incorporated by reference.

TECHNICAL FIELD

The present disclosure relates to a yarn feeding arrangement. In particular, the present disclosure relates to a yarn feeding arrangement suitable for an arrangement comprising a motor driven bobbin that typically can be used for a weaving machine weaving flat or tape yarns where the weft yarn shall be presented to the weaving machine without twist.

BACKGROUND

A general development trend in weaving is that the speed of the weaving machine is constantly being increased. Another trend is the increased use of flat or tape formed yarns, which shall be inserted without any twist. Examples of such yarns are polypropylene tape, carbon fiber tape, aramid and glass fiber tape. Presently, the speed of a rapier weaving machines weaving flat or tape yarns without twist is limited by the low capacity of the zero-twist yarn feeding devices that exist today.

Existing systems for feeding yarns without twist (zero-twist) typically have an un-wind motor that is controlled by measuring the length of a big loop buffer that is located between the bobbin and the weaving machine. The loop can be either free hanging, or have a mechanical member that forms the loop by gravity, pressurized air or by under-pressure (aspirator). The existing systems can be considered as storage feeders, where the weaving machine can take the amount of yarn it needs, so called "negative yarn feed" or "feed on demand".

WO2018013033 describes a yarn feeding arrangement configured to enable weaving of textile at high speed with zero-twist typically using a rapier weaving machine. The weft yarn feeding arrangement is adapted to control of weft yarn by at the same time control the speed of a motor driven bobbin and a motor driven loop buffer device. With this yarn feeding system the weft yarn will be controlled and not be let free. Thus, the risk for the yarn to twist or entangle is eliminated. The motor driven loop buffer device is driven based on pre-stored information about the speed and position of the rapier(s) in relation to the weaving machine angle position. The motor driven bobbin is driven to supply the correct amount of weft yarn during each cycle of the weaving machine.

There is a constant desire to improve yarn feeding to textile machines. Hence, there is a need for an improved yarn feeding device.

SUMMARY

It is an object of the present invention to provide an improved yarn feeder arrangement.

This object and/or others are obtained by the weft yarn feeding arrangement as set out in the appended claims.

While useful for many applications, the system described in WO2018013033 can for some applications require an improved control. Thus, it has been realized that the control procedure described in WO2018013033 can be improved. This is particular with regard to the start-up procedure of the weaving process. When starting a weaving machine operating at a high speed, the control needs to be correct more or less from the first insertion of weft yarn. Otherwise there is a risk that the control performed will never enter a steady state where the control procedure can take care of any small deviations in the yarn feeding.

This problem is solved by providing a learning procedure. The learning procedure aims at providing control data to the controller about system components and behavior of system components of the yarn feeding arrangement beforehand, such that the controller has enough knowledge of the system components to correctly control the yarn feeding arrangement before the weaving machine is started to operate at full operational speed.

During the learning procedure the controller can gain data of the geometry of the yarn path from the bobbin to the buffer arm, the buffer arm, and the sensor and or take up device. Furthermore, the controller can be provided with unroll speed of yarn from the bobbin and data about yarn consumption of the weaving machine.

The learning procedure can advantageously be performed before starting to weave a new article or after change of bobbin.

In accordance with one embodiment a yarn feeding arrangement for feeding weft yarn to a weaving machine is provided. The yarn feeding arrangement comprises a motor driven bobbin drive and a motor driven loop buffer device. The yarn feeding arrangement further comprises a sensor configured to detect yarn motion. The yarn feeding arrangement comprises a controller for controlling a motor of the motor driven bobbin drive and to control the motor driven loop buffer device. The controller is adapted to drive the motor of the motor driven bobbin drive at a speed to feed a determined essentially average amount of weft yarn to be consumed by the weaving machine and to drive the motor of the motor driven loop buffer device based on the difference between the output yarn motion from the motor driven bobbin and a motion model of weft insertion yarn motion in the weaving machine. The controller is adapted to determine the motion model based on a learning procedure. The learning procedure comprises to operate at least one of the motor driven bobbin drive and the motor driven loop buffer device. The operation of the at least one of the motor driven bobbin drive and the motor driven loop buffer device can in particular comprise to drive at least a motor of the motor driven bobbin drive and or the motor driven loop buffer device during the learning procedure. Hereby, the model according to which the yarn feeding arrangement operates can be made very precise. This in turn reduces the risk of a mal-functioning yarn feed and the yarn feeding arrangement can be made to work with small tolerances.

In accordance with one embodiment, the yarn feeding arrangement is configured to perform the learning procedure before starting to weave a new article or after change of bobbin. Hereby the model used to control the yarn feeding arrangement can be adapted to the prevailing conditions and the risk for malfunction is reduced.

In accordance with one embodiment, the controller is adapted to during the learning procedure determine the amount of yarn per revolution unrolled from the bobbin. Hereby, a precise measure of the amount of yarn un-rolled from a bobbin. This makes it possible to control the speed at which the bobbin is rotated to match the amount of yarn consumed by a weaving machine.

In accordance with one embodiment, the yarn feeding arrangement is configured to during the learning procedure receive data when the weaving machine is run in a slow-motion speed, the slow-motion speed being lower than normal speed of operation of the weaving machine. By running the weaving machine in slow-motion and receive data during a weft yarn feed in slow motion, the model according to which yarn is moving in the yarn feeding arrangement can be improved.

In accordance with one embodiment, the bobbin motor is in a stationary mode during at least a first period of time when the weaving machine is run in the slow-motion speed. Hereby it can be facilitated to measure the amount of weft yarn moving through the yarn feeding arrangement when operating the weaving machine.

In accordance with one embodiment, the learning procedure at least one complete weaving machine cycle. Hereby the amount of yarn that the weaving machine consumes during a weaving machine cycle can be correctly determined.

In accordance with one embodiment, wherein the controller is configured to determine a gear ratio between a drive of the motor driven bobbin and the weaving machine during the learning procedure. Hereby a measure that enables running the motor driven bobbin drive at a correct speed that independent of the speed of the weaving machine can be obtained.

In accordance with one embodiment, wherein the motor of the motor driven bobbin drive is adapted to unroll weft yarn from the bobbin using a center drive mechanism. Hereby an easy to control mechanism for controlling the speed of rotation of a bobbin is obtained.

In accordance with one embodiment, the sensor comprises a sensor arm. The sensor arm can have an equivalent mass of less than 10 grams, in particular 1-4 grams. In particular the mass can be in the same order, e.g. less than 10 times or less than 20 time the mass of the yarn in the yarn in the yarn buffer at a particular point in time. This will cause the yarn acceleration to have an impact on the sensor arm that can be determined. Hereby the sensor will be able to follow speed changes in the weft yarn feed with high accuracy.

In accordance with one embodiment, the yarn feeding arrangement is configured to use the model obtained by the learning procedure at start of a weaving process and wherein the buffer arm is in a position where the maximum length of yarn is stored. Hereby an efficient start procedure is obtained that can use the full length of the buffer to adjust for any inaccuracies in the model used at start of the weaving process.

In accordance with one embodiment, the yarn feeding arrangement is configured to use the model obtained by the learning procedure at start of a weaving process and wherein the buffer arm is in a position where the minimum length of yarn is stored. The yarn feeding arrangement is configured to receive a start in advance signal from the weaving machine and the yarn feeding arrangement is configured to start to accelerate the bobbin and take up the yarn with the buffer arm upon reception of such a start in advance signal. Hereby an alternative efficient start procedure can be obtained that allows the bobbin to be accelerated relatively slowly.

In accordance with one embodiment, the yarn feeding arrangement is configured to use the model obtained by the learning procedure at start of a weaving process in a speed ramp up sequence. Hereby, a start procedure that allows for a relatively slow acceleration of system components can be obtained. The system needs not to go to full operational speed directly.

In accordance with one embodiment, the yarn feeding arrangement is configured to use the model obtained by the learning procedure at start of a weaving process after a switch from empty to full bobbin. Hereby the yarn feeding arrangement can learn about new properties of a new bobbin before starting to operate the weaving machine at full operational speed.

In accordance with one embodiment, the yarn feeding arrangement is configured to perform a feed forward control of the yarn feeing arrangement based on the motion model determined based on the learning procedure. Hereby an efficient control of the yarn feeding arrangement can be obtained that allows the yarn feeding system to compensate for any inaccuracies of the model obtained during the learning procedure.

BRIEF DESCRIPTION OF THE DRAWINGS

The present invention will now be described in more detail by way of non-limiting examples and with reference to the accompanying drawings, in which.

DETAILED DESCRIPTION

Figure 1:
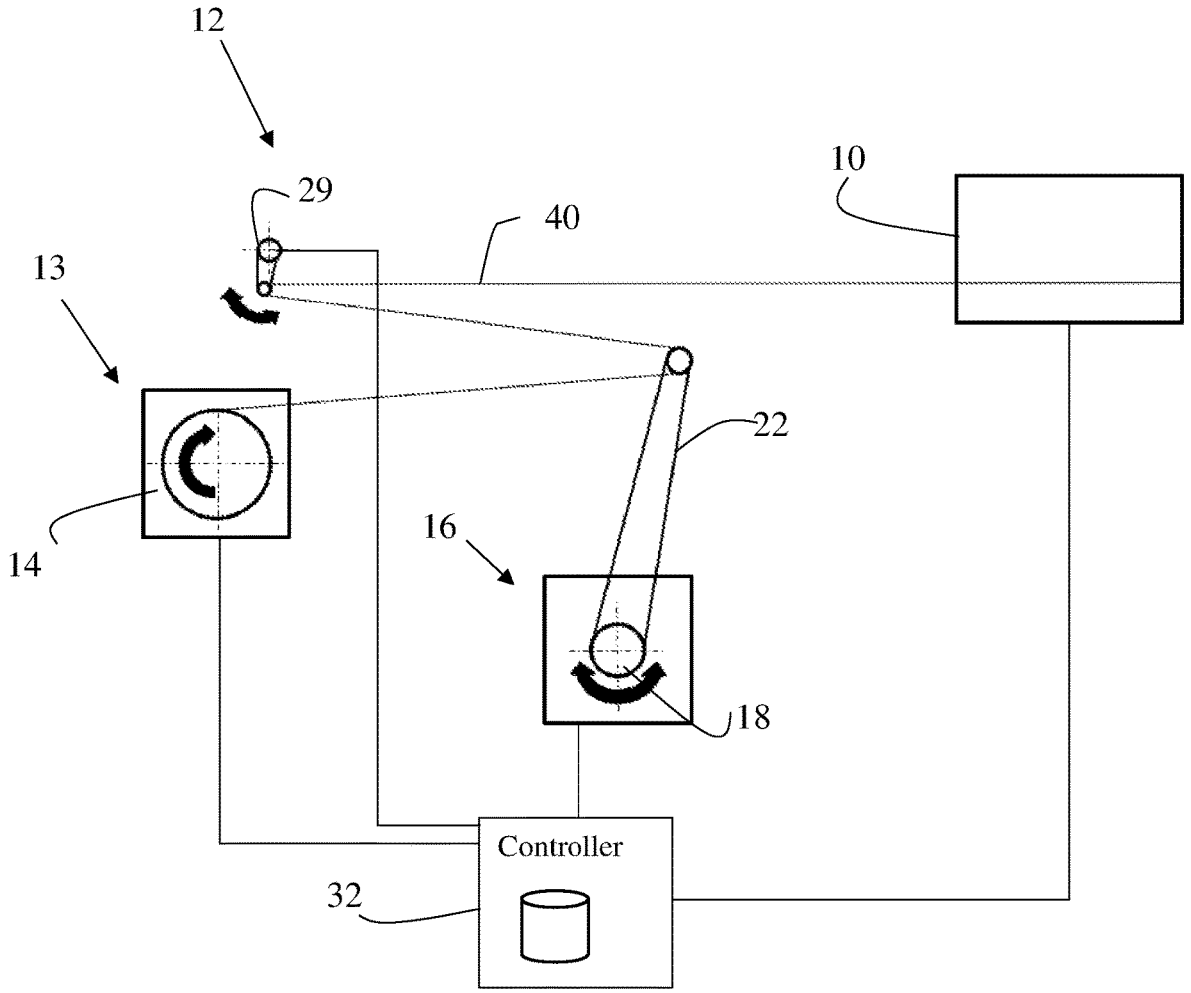
FIG. 1 is a view illustrating a weft yarn feeding device.

In the following a weft yarn feeding arrangement for a weaving machine will be described. In the Figures, the same reference numerals designate identical or corresponding elements throughout the several figures. It will be appreciated that these figures are for illustration only and are not in any way restricting the scope of the invention. Also, it is possible to combine features from different described embodiments to meet specific implementation needs.

For many types of yarns twist is not allowed to exist in the finished fabric. For such yarns the yarn feeding cannot twist the yarn and the yarn is fed with zero twist, that can be termed a zero-twist yarn feeding arrangement.

In FIG. 1 a weft yarn feeding arrangement 12 comprising a motor driven bobbin 13 in combination with a motor driven loop buffer device 16 is shown. The arrangement 12 can be used to feed a yarn with zero twist. In the arrangement 12, weft yarn 40 is tangentially un-rolled from the motor driven bobbin 13. The motor driven bobbin 13 is connected to a motor 14. The motor 14 can in accordance with some embodiments be directly connected to a shaft on which the bobbin in placed. In accordance with some embodiments the motor is connected via a gearing mechanism or the bobbin is rotated by the motor 14 by a line shaft. Other configurations for rotating the bobbin by controlling the motor 14 can be envisaged. The weft yarn passes the motor driven loop buffer device 16, which is adapted to form a weft yarn buffer. The weft yarn is supplied from the motor driven buffer device 16 to a weaving machine 10. The weaving machine 10 can for example be a rapier weaving machine or a projectile weaving machine. The motor driven buffer device 16 can be formed by a yarn loop-forming arm 22, a buffer arm. The arm 22 can be moved to form an adjustable buffer of weft yarn to be supplied to the weaving machine 10. The movements of the arm 22 are achieved by a motor 18 connected to the arm 22. The arm can be connected either directly to the motor shaft or via a gear arrangement to the motor. A force sensor or a tension sensor 29 can also be provided to detect and output a signal representing the actual yarn tension. In the set-up in accordance with FIG. 1 the weft yarn inserted in to the weaving machine will always have a controlled yarn tension, i.e. there will be no loose yarn that can be drawn into the weaving machine. The arm motor 18 and also the motor 14 of the motor driven bobbin 13 can be controlled by a controller 32 as will described in more detail below.

In accordance with one embodiment the motor driven bobbin 13 is configured to unroll the bobbin by a center drive as is shown in FIG. 1.

When controlling a weft yarn feeding arrangement 12 as described above, a controller 32 can be used. The controller 32 can be provided with control data to control the speed of the motor 14 driving the bobbin and the movement of the motor driven loop buffer device 16.

By controlling the motor driven bobbin 13 and motor driven loop buffer device 16, weft yarn can be supplied to the weaving machine correctly at high weaving speed.

The input to the controller for determining control data can in accordance with one embodiment be one or many of:

- signals representing the state of the weaving machine. The signals can for example represent actual position (machine angle, machine encoder position), start in advance, speed ramp up, pattern, channel sequence or other signals representing events or motions in the weaving machine that could impact the insertion speed or sequence of the weft yarn. The signals can also be used to suppress an insertion if the weaving machine is performing a so-called pick finding. For example, the weaving machine can in accordance with one embodiment be run in slow motion or back and forth to remove a faulty pick. During such a procedure, the yarn feeding arrangement can be controlled to not release any yarn. Another example can be that the weaving machine moves in a special sequence to avoid start marks in the woven textile. Based on these movements and commands from the weaving machine, the controller 32 of the yarn feeding arrangement 12 can be configured to perform pre-determined actions.
- signals from the motor driving the bobbin. The signals can for example be a signal representing the position and/or speed of the motor, for example a signal from a rotation/angle sensor such as an encoder. Other signals representing the state of the motor could also be used. Examples can here be the motor current. The motor current provides information about the momentum of the motor that can be used to determine the acceleration of the bobbin.
- signals from the loop-forming arm motor. The signals can for example be a signal representing the position and/or speed of the motor, for example a signal from a rotation/angle sensor such as an encoder. Other signals representing the state of the motor could also be used.
- signals indicative of the present (actual) weft yarn tension, for example signals from a force sensor.
- signals representing the length of the inserted yarn measured at the right-hand side of the machine, for example by a sensor that measures the position or length of the free end of the yarn, so called waste length sensor.
- a signal representing the momentary (actual) bobbin circumference.
- parameters P describing the particular set-up for, for example, loop-forming arm length, position of the weft yarn guides, settings of the weaving machine. In some embodiments. the position of various components such as the position of the bobbin, the position of the buffer arm, and the position of the sensor arm can be used. The positions of the components can be used to determine the length of yarn based on the angular relationship between the buffer and the bobbin and sensor arm, respectively. For a rapier weaving machine, the position of rapier(s) in relation to the rapier machine angle position etc. In particular, a look-up table or some other relation for the position of rapier(s) in relation to the weaving machine angle position can be provided. From such a look-up table the desired insertion speed of the weft yarn to the weaving machine can be deduced based on the actual weaving machine angle. Hereby the arm can be controlled to a position that allows for the correct amount of yarn to be fed to the weaving machine at a corresponding machine angle. The arm can be controlled based on a mathematic model following the amount of yarn to be fed at a particular machine angle. The mathematic model can in accordance with some embodiments be formed by cubic splines.

From the controller 32 speed/position control signals to the loop-forming arm motor 18 and bobbin un-wind motor 14 can be output.

The controller 32 is programmed to run the bobbin un-wind motor at a speed at which the average amount of weft yarn that the weaving machine consumes is unwound from the bobbin or close to such a speed. At the same time the controller is programmed to run the motor of the loop-forming arm so that the movement of the arm compensates for the difference of the essentially constant unwind speed of the weft yarn from the bobbin and the intermittent consumption of weft yarn by the weaving machine. Generally, the motor of a motor driven buffer device is driven to keep the buffered yarn length equal to, or within a pre-determined range around, the difference between the amount of yarn unrolled from the bobbin and the amount of yarn consumed by the weaving machine during the insertion to thereby control the yarn tension. The target of the control system can in accordance with one embodiment be to have a constant yarn tension or to follow a varying yarn tension curve over a weaving machine cycle. In an alternative or supplemental configuration, the speed of the motor of the motor driven bobbin is adjusted based on another input signal than a signal representing the actual yarn tension. For example, a signal representing the position of the motor driven loop buffer device can be used or any other signal indicative of if the bobbin is unwound at a speed that matches the average yarn consumption of the weaving machine. Also, a signal indicative of accumulated errors in the amount of yarn fed to the weaving machine can be used. Hereby errors compensated for by the yarn buffer can be restored and the yarn buffer be returned to a neutral position, or the bobbin can be rotated faster or slower.

A force sensor 29 detecting the yarn tension can be used to give feedback to the control system in order to correct for the error between the expected consumption of the weaving machine and the real consumption, both in average and during the actual insertion. The control system can also be programmed to correct for the error between the expected amount of yarn unrolled from the bobbin and real amount based on a feedback signal from the force sensor.

In a set-up where the bobbin is driven on its center shaft, the control output signal can be revolutions per minute (rpm). Thus, it is important to know the actual circumference of the bobbin. This is especially important at start-up of the system. To gain this information a sensor that measures the diameter of the bobbin can for example be used, or a learning procedure as described below can be performed.

The motors of the weft yarn feeding arrangement can be controlled according to the following principles:

The controller 32 for control of the motor running the loop-forming arm can have predetermined values or functions and parameters for the required buffer position in relation to the weaving machine angle, a so-called feed forward control model. The controller is also provided with information about the dynamics of the system. When the weaving machine is running the motor driven loop-forming arm will be controlled to act accordingly in order to always have the buffer arm in the proper position at all weaving machine angles and weaving machine speeds. The force sensor gives a feedback to the control system so it can correct deviations, such as external influence and also dynamic model pre-set values or actual running inaccuracy.

To improve the control a learning procedure aiming at providing control data to the controller about system components and behavior of system components when the yarn feeding arrangement beforehand can be applied. The learning procedure gives the controller 32 knowledge of the system components before the weaving machine is started to operate at full operational speed. Hereby, control can be improved and the risk for faulty control is reduced.

Figure 2:
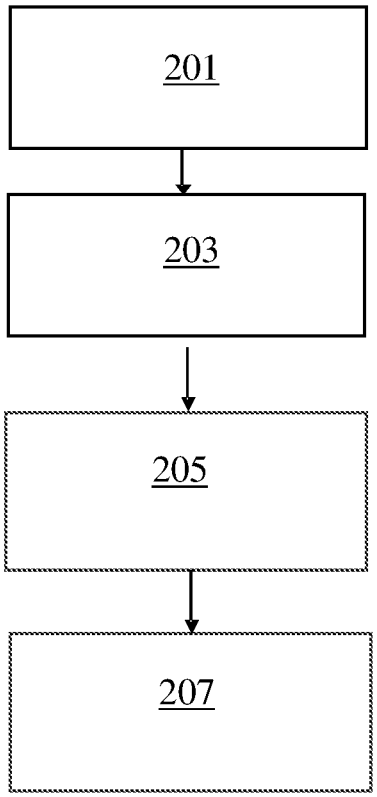
FIG. 2 is a flow chart illustrating different steps performed when forming a weft yarn buffer.

In FIG. 2, a flow chart illustrating some steps when controlling a weft yarn feeding arrangement 12 using a learning procedure is shown. First, in a step 201 a learning procedure is run. During the learning procedure, at least some parts of the yarn feeding arrangement is operated to gain knowledge about parameters of the yarn feeding arrangement or of the weaving machine that can be used to control the yarn feeding arrangement. Operation of the yarn feeding arrangement will typically involve driving at least one of the motors either backwards or forward. For example, the bobbin motor 14 and or the buffer arm motor 18 can be driven. The learning procedure can be any procedure run to establish data about the components of the yarn feeding arrangement 12. Various possible procedural steps that can be performed are described in more detail below. Next, in a step 203, a model for weft insertion yarn motion in the yarn feeding arrangement is determined based on the learning procedure. Then, in a step 205, the motor of the motor driven bobbin is driven at a speed to feed a determined essentially average amount of weft yarn to be consumed by the weaving machine. The motor of the motor driven loop buffer is, in a step 207, driven based on the difference between the output yarn motion from the motor driven bobbin and the model of weft insertion yarn motion in the weaving machine. The speeds set in steps 205 and 207 can then be continually adjusted based on feedback information. The start values determined during the learning procedure will ensure that the control can be started with high speed.

Figure 3:
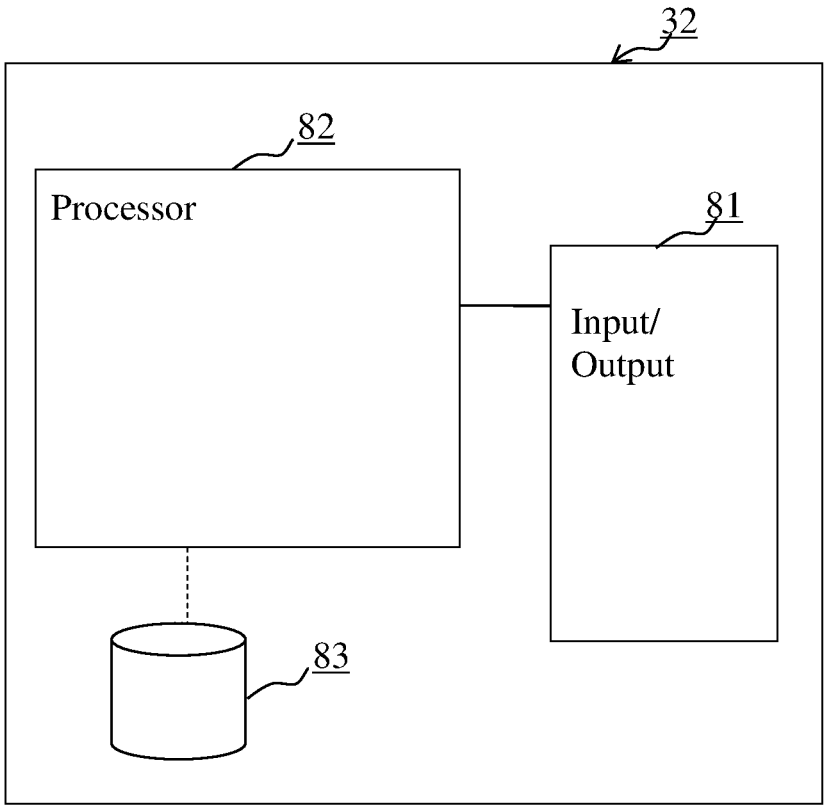
FIG. 3 is a view of a controller.

In FIG. 3, a controller 32 for controlling a weft yarn feeding arrangement 12 is depicted. The controller 32 can comprise an input/output 81 for receiving input signals for parameters used for controlling the yarn feeding device as set out above. For example, the input signals can be various sensor signals from sensors of the yarn feeding device. For example, sensor signals can be provided from any type of sensor, e.g. optical sensors, mechanical sensors or capacitive sensors. The yarn tension sensor(s) can for example be a piezo resistive type sensor, a strain gauge type sensor, or by sensing the position of a resilient or spring-loaded yarn guide. Hereby the yarn length can be determined. The yarn length can be used as an alternative or in combination with a yarn tension signal as a feed-back signal to control the motor speed of the motor driven loop buffer device and in some embodiments as a feed-back signal to control the motor speed of the motor driven bobbin. Other types of input signals can also be provided such as encoder signals and the like. Also signals from the weaving machine can be input to the controller 32 and used to control the weft yarn feeding arrangement. In particular, the weaving machine angle can be provided. The input/output 81 outputs motor control signal(s) to the controlled motors of the weft yarn feeding arrangement. The controller 32 further comprises a microprocessor or some other suitable data processing device such as a Central Processing unit (CPU) or a Digital Signal processor (DSP) that also can be referred to as a processing unit 82. The processing unit 82 is connected to and can execute computer program instructions stored in a memory 83. The memory 83 can also store data that can be accessed by the processing unit 82. The data in the memory can comprise pre-stored data relating to the weaving machine 10. In particular, a model of the rapier movements can be stored to form a model of the weft yarn speed into a rapier weaving machine. The computer program instructions can be adapted to cause the controller to control the yarn feeding arrangement in accordance with the teachings herein. The controller 32 can be located at any suitable location. For example, the controller 32 can be integrated in a motor of the yarn feeding arrangement. The controller 32 can also be distributed at different locations. For example, one controller can be provided for each motor to be controlled and a central controller can be provided as a central control unit to control the motor controllers.

The yarn feeding arrangement as described herein is a so-called positive feed system; it measures and outputs a pre-defined amount of yarn in synchronism with the weaving machine angle. In other words, the yarn feeding arrangement controls the amount of yarn available for the weaving machine in that the weaving machine cannot draw more yarn than the yarn feeding arrangement has fed. This in contrast to a so-called negative feeding arrangement where the weaving machine draws an amount of yarn without being limited by how much yarn the yarn feeder can supply. Thus, in a negative feed system, the weaving machine has more or less free access to yarn, whereas in positive feed systems the yarn feed arrangement determines how much yarn can be fed to the weaving machine. The feedback to correct errors between the pre-defined amount of yarn and the real consumption in the positive feed system is obtained by a sensor, in particular a yarn tension sensor. In one embodiment, the yarn tension sensor is combined with a small mechanical or spring-loaded yarn buffer.

Figure 4:
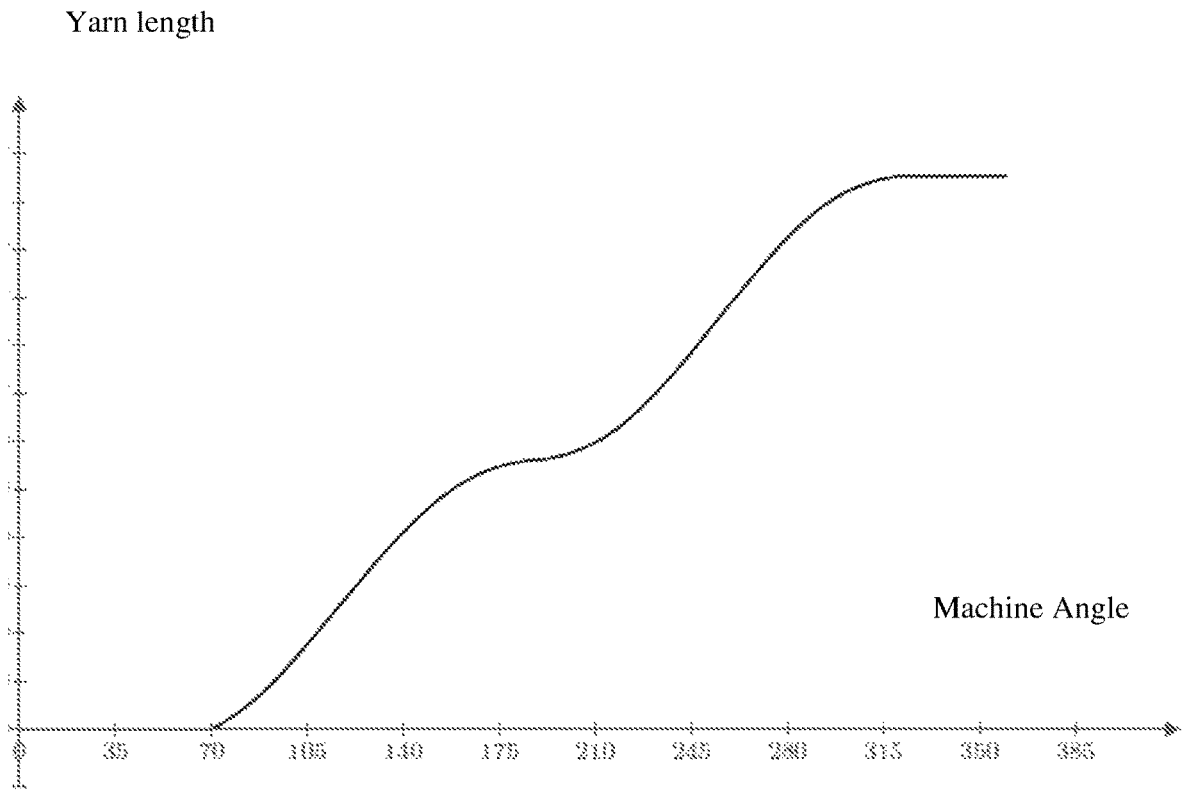
FIG. 4 illustrates the amount of yarn delivered by the yarn feeding arrangement in relation the weaving machine angle.

In FIG. 4, the amount of yarn output from the yarn feeding arrangement is depicted during a complete machine cycle (0-360 degrees). As can be seen the amount of yarn output per machine angle will vary.

Figure 5:
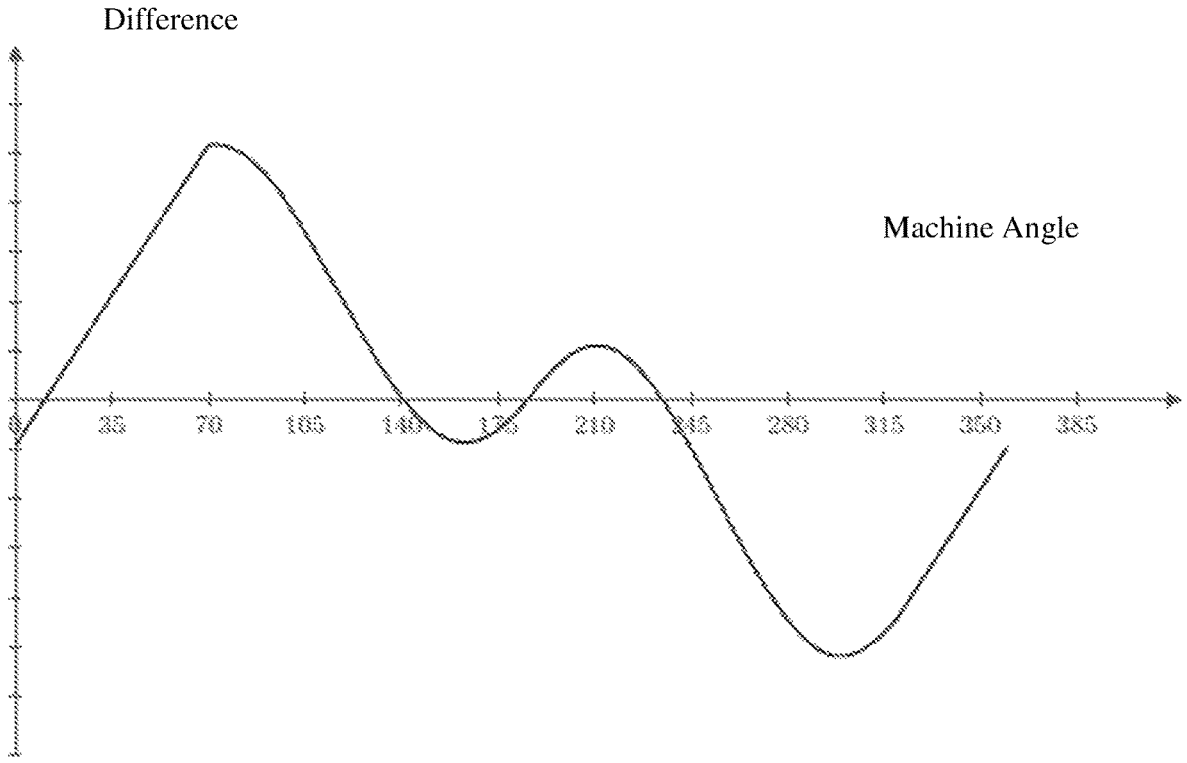
FIG. 5 illustrates the difference between the amount of yarn fed from a motor driven bobbin and the amount of yarn fed from the yarn feeding arrangement to the weaving machine.

In FIG. 5, the difference between the amount of yarn output from the yarn feeding arrangement and the amount received by from the motor driven bobbin is depicted. The curve depicted in FIG. 5 is the curve that the motor driven loop buffer device aims to follow and which the motion model based on the learning procedure aims at mimicking.

Exemplary Learning Procedures

Determination of Bobbin Diameter

If the bobbin is driven in its center it is important to know the actual outside diameter/circumference of the bobbin or some other parameter from which the amount of yarn that is unrolled from the bobbin per angle. Another component that can affect the yarn motion in the yarn feeding arrangement is the yarn store length on the bobbin as well as the slope (gradient) of the yarn wound on the bobbin. When unrolling the yarn from the bobbin, the yarn will sweep from side to side and thus influence the length drawn from the bobbin at each rotation of the bobbin.

In accordance with one exemplary embodiment of the learning procedure, the controller is configured to determine the drawn of length for each rotation of the motor driven bobbin. This can be performed by a thread up of the yarn feeding arrangement and fix the free end of the yarn, for example in the entrance of the insertion system of the weaving machine. The yarn is then stretched to provide a starting point of the learning procedure. The motor driven bobbin is then rotated and the yarn tension or position sensor detects the difference in tension or position. With use of this information the controller is configured to run the motor driven buffer arm to keep the yarn tension or the position of the sensor arm constant or according to a predetermined pattern.

By detecting the angle of the buffer arm and compare this with the rotation of the bobbin and a model of the geometry of the yarn feeding arrangement, the controller can determine the length of yarn for each revolution and each degree of rotation of the bobbin. By using a substantial portion, e.g. more than 50%, of the stroke of the buffer arm when rotating the bobbin, a good precision can be achieved. In accordance with some embodiments, the position or angle of the sensor arm can be used in the determination of the length of yarn per revolution of the bobbin.

The learning procedure for determining the drawn of length for each rotation of the motor driven bobbin is preferably performed each time a new bobbin with an unknown diameter is introduced. However, if the same type of bobbin is used again and again it is typically unpractical to perform the learning procedure after each bobbin change (when a bobbin is finished it has to be replaced with a new one). In this case a user can instruct the yarn feeding arrangement that a new, full, bobbin is put in operation. This can be done by a push button or a command on a Human-Machine Interface (HMI), or any other method. When the controller of the yarn feeding arrangement receives this information, the controller can be configured to replace a latest parameter of the nearly empty bobbin with a stored value representing a full bobbin. The weaving machine can be started immediately after threading up and without any learning procedure.

Slow-Motion Insertion

By making in a learning procedure an insertion in slow motion a lot of data can be captured before operating the weaving machine at full operational speed. This is advantageous because starting the weaving machine at full operational speed before a good control model is obtained could potentially lead to failure. By operating the weaving machine in slow motion, important data for the control model can be captured that allows for driving the weaving machine at full operational speed with feed forward control. In a slow-motion operation, the weaving machine is operated at a speed below normal speed of operation. Typically, the weaving machine can be operated at 50 rpm or below. During the slow-motion insertion, the tension/position sensor gives input to the controller of the yarn feeder arrangement in a way so either the bobbin is rotated, or the buffer arm is moved or both the bobbin and the buffer arm are moved at the same time. During the slow-motion insertion, it is aimed to keep the yarn tension constant or at predetermined target tensions, or to keep the sensor arm in a constant position or two or several predetermined positions. By during such a slow-motion insertion then capture the angle and/or position of the weaving machine, the bobbin, the buffer arm and the sensor arm and comparing these, the length of yarn inserted in each weaving machine cycle a curve for yarn motion through the yarn feeding arrangement can be determined for a complete machine cycle. I.e. the controller can determine the amount of yarn fed from the bobbin and consumed by the weaving machine for each moment in the machine cycle. Another way of describing the length of yarn inserted in each machine cycle is to calculate a gearing ratio between the bobbin and the weaving machine. The gearing ratio will yield a ratio between the angular speed of the bobbin and the average yarn speed of the weaving machine. Thus, the gearing ratio represents the relation between yarn length per complete weaving machine cycle and the corresponding bobbin rotation angle. The gearing ratio parameter is speed independent because the angular speed of the bobbin will increase linearly with the average yarn speed inserted into the weaving machine during a machine cycle.

To increase the accuracy, the learning procedure can in accordance with some embodiment comprise several repeated slow-motion insertions. The repetition can be performed, either with feedback, such as by using a proportional-integral-derivative (PID) regulator, or by running the curve in feed forward mode and read out the deviation, or a combination of both.

The slow-motion insertion described above will enable capturing data to be used by the controller for taking into account static properties of the yarn feeding arrangement. However, to also include dynamic properties change caused by for example elasticity of yarn and mechanical components that might occur when running at a speed higher than slow motion, a learning procedure can also be run at an increased speed. The increased speed is higher than the slow-motion speed and can typically be about 25%-50% of full operational speed. In accordance with some embodiments, the increased speed is the full operational speed.

Further, to improve the data received and used by the controller, the sensor arm preferably has a very low moment of inertia, this to be able to follow the rapid speed changes that occurs in a modern weaving machine. This can be particularly advantageous for a two-sided rapier machine, where the rapier takes the yarn at start of the insertion when the rapier already has accelerated to a significant speed, as well as at end of insertion where the rapier often releases the yarn at a comparatively high speed. The yarn will then be exposed to a speed step. To follow the speed step without causing high tension deviations, the sensor arm must have a very low moment of inertia and a force from for example a spring that is high enough to follow this rapid speed change. The spring force can then typically be high enough to give a yarn tension of up to a few hundred cN, typically 50-200 cN. The mass of inertia can advantageously be in the range of a few grams equivalent mass, typically 1-4 grams. Equivalent mass is the mass that the yarn experience and that it needs to shift to move it, or moment of inertia divided by the radius in square.

To keep the mass of inertia low, the design of the sensor arm and also the buffer arm is made with very light elements. Most tape yarns works well with a normal sliding friction against the senor arm deflection bar and the buffer arm deflection bar. This bar can be made of ceramic or aluminum, or any light material below some pre-determined density, coated with a wear resistant surface. Some yarns however have a very high friction or is sensitive for sliding against a deviation element. In this case a roller that has a bearing can be used. Sensitive yarns are for example some carbon and glass fiber yarns and tapes.

The sensor comprises a sensor arm and it is advantageous if the length of the arm is sufficient to take up or release the yarn length that is a result from errors in the regulation and the yarn length that results from the speed steps when the rapier takes and release the yarn and the buffer arm is not fast enough to follow. Typically, the sensor arm can have a length between 15 mm and 70 mm, in particular between 20 mm and 40 mm.

The force of the sensor arm can in one embodiment be settable by for example an spring with variable force, or via an actuator for example an electric motor or electromagnet. The force can be settable to optimize a certain article, for example can yarns of different size and weight need different spring force to have optimized running conditions. The force can in one embodiment be settable also within the pick to obtain different yarn tension in different zones of the insertion.

Learning Procedure

There are a numerous different possible combinations of learning possible using the different components of the yarn feeding arrangement such as buffer arm, bobbin unwind, machine stand still, slow motion and running. They can be performed in different order.

Advantageously the controller is configured to obtain knowledge about the gearing ratio between the bobbin and the weaving machine and the motion of the yarn in the yarn feeding arrangement during a machine cycle. This can also be seen as the speed of yarn unwound from the bobbin and the speed of yarn entering the weaving machine and the yarn motion in the yarn feeding arrangement.

The controller can be connected to the weaving machine to obtain the machine angle information. It is then not necessary to stop between machine cycles or run whole cycles. In a preferred embodiment at least one machine cycle (360 degrees) is run during the learning procedure.

In a preferred embodiment the weaving machine is first run slowly where a feedback regulation is possible to use. The data is then saved and computed and used to partly or fully run a feed forward control in higher speeds.

A typical learning procedure when introducing a new yarn or a new machine can be as follows:

1. Thread up the machine and position the buffer arm in a position where it buffers at least one insertion. Make a, first, slow-motion insertion and use information from the sensor arm to control the buffer arm so it gives the yarn needed to follow the insertion procedure, e.g. the rapier(s) in a rapier machine. The bobbin is kept still during the slow-motion insertion. After one complete machine cycle, 360 degrees, the weaving machine is stopped. The buffer arm is then moved back to its original start position and the bobbin is rotated to give out corresponding length of yarn. By comparing the rotation of the bobbin with the buffer arm movement and the sensor position, a gearing ratio between the motor driven bobbin and the weaving machine is determined. The controller now knows how much yarn the weaving machine consumes for each insertion and thus how much yarn needs to be unwound from the bobbin during a complete machine cycle. If a higher precision is needed this can be repeated for several weaving machine cycles.

2. The buffer arm is moved to the start position for weaving and the bobbin is rotated to keep the yarn stretched and the sensor arm in the desired starting position. Another, second slow-motion insertion is then performed and the bobbin is rotated according to the gearing ratio calculated in step 1, i.e. it rotates so it follows the machine angle and after one machine cycle the bobbin has released the yarn length that corresponds to one insertion. The sensor arm signal obtained is used to control the buffer arm so it follows the insertion of the weaving machine and by comparing the amount of yarn unwound from the bobbin, the weaving machine angle, the sensor arm position and the buffer arm position the motion of the yarn in the yarn feeding arrangement, i.e. from leaving the bobbin to entering the weaving machine is determined. A feed forward curve to be used by the control system is determined based on the determined motion of yarn in the yarn feeding arrangement and used in the next step. If a higher precision is needed this can be repeated for several weaving machine cycles.

3. Step 2 is repeated in higher speed. Dynamic properties are obtained and the controller makes compensation for dynamic properties. During step 3 the determined feed forward curve from step 2 can be used.

4. The control system now has information enough to start weaving. An ILC (Iterative Learning Control) component in the controller can be used to compensate for the deviations that occur during running of the system.

Iterative Learning Control (ILC) is in accordance with Wikipedia, a method of tracking control for systems that work in a repetitive mode. Examples of systems that operate in a repetitive manner include robot arm manipulators, chemical batch processes and reliability testing rigs. In each of these tasks the system is required to perform the same action over and over again with high precision. This action is represented by the objective of accurately tracking a chosen reference signal r(t) on a finite time interval. The repetition allows the system to improve tracking accuracy from repetition to repetition, in effect learning the required input needed to track the reference exactly. The learning process uses information from previous repetitions to improve the control signal ultimately enabling a suitable control action can be found iteratively. The internal model principle yields conditions under which perfect tracking can be achieved but the design of the control algorithm still leaves many decisions to be made to suit the application. A typical, simple control law is of the form:

$$U_{p+1}=U_p+K*e_p$$

where $U_p$ is the input to the system during the p:th repetition, ep is the tracking error during the p:th repetition and K is a design parameter representing operations on $e_p$. Achieving perfect tracking through iteration is represented by the mathematical requirement of convergence of the input signals as p becomes large whilst the rate of this convergence represents the desirable practical need for the learning process to be rapid. There is also the need to ensure good algorithm performance even in the presence of uncertainty about the details of process dynamics. The operation K is crucial to achieving design objectives and ranges from simple scalar gains to sophisticated optimization computations.

Start of Machine

At start of a weaving machine, such as a rapier weaving machine, the machine typically accelerates from zero to a substantial speed, for example 100 rpm, or 300 rpm, or even up to today's industrial speeds of 650 rpm for a 2 m wide machine. A typical industrial speed of a 4 m wide machine is 350 rpm.

The buffer arm with its drive and control is dimensioned to follow the maximum speed of the insertion of the weaving machine. Dimensioned means that the length of the buffer arm must be sufficient to buffer at least the difference in length between average speed of the yarn consumption and the momentarily speed of the yarn. It is however for other reasons practical to have a buffer arm that can buffer at least the yarn length for one complete weaving machine cycle (360 degrees)+some extra for regulation purpose. A wide machine demands a longer arm.

The acceleration of the bobbin can in some applications be a limiting factor. A bobbin with big outside diameter and a heavy weight means a big moment of inertia. A big moment of inertia cannot be accelerated too fast for several reasons.

A) It takes a too big torque to accelerate a big moment of inertia and thus the motor, gears and drive train will be unpractical big and too costly.

B) If a too big torque is applied to the center of the bobbin the center of the bobbin will follow the acceleration curve, but the outside of the bobbin risk to not follow and the layers of the yarn in-between the center and the outside will collapse.

C) If a too big torque is applied to the outside of the bobbin via for instance driven rollers, the top layers of yarn on the outside of the bobbin will be damaged by either friction when the rollers slip, or by pressure force if the pressure from the rollers to prevent slipping is too big.

To limit the acceleration of the bobbin different start procedures can in accordance with some embodiments be applied, for example:

1. Before start of the weaving machine, the buffer arm is moved in a position so it buffers as much yarn as possible. At weaving machine start, the buffer arm and the bobbin start to move as soon as the sensor arm starts to move and give a signal. If the buffer arm stores more than one insertion of weft yarn, there is more time for the bobbin to accelerate to its full speed. For example, for the first insertion, ½ of the yarn length consumed by the weaving machine can be taken from the buffer formed by the buffer arm and ½ of the yarn length consumed by the weaving machine can be taken from the bobbin. For the next insertion, the full length of yarn consumed by the weaving machine can be taken from the bobbin.

If needed the bobbin acceleration can be even further reduced if the second insertion is still configured to also take yarn from the buffer arm where the buffer arm at the end of the second insertion can be configured to be in a position where the buffer is at its minimum. For example, for the second insertion, ¼ of the yarn length consumed by the weaving machine can be taken from the buffer arm and ¾ of the yarn length consumed by the weaving machine can be taken from the bobbin. In such a startup procedure, the bobbin speed can then temporarily be set a bit over the average yarn consumption to compensate for the loss in the beginning, a so-called speed overshoot. With this start up procedure the only needed synchronization with the weaving machine is the actual weaving machine angle by means of for instance an encoder or resolver.

2. If the control system of the yarn feeder arrangement is provided with information about the machine start in advance an improved start sequence can be obtained. With information about how long time it takes from the start in advance signal until the machine really starts a calculation can be done to start up the yarn feeder arrangement before the weaving machine. Hereby the motor driven bobbin already been, at least partly, accelerated before the weaving machine starts and the consumption of yarn begins. For example, the start position of the buffer arm can be set with minimum of yarn stored in the buffer formed by the buffer arm. At start of the yarn feeding arrangement, the bobbin starts to accelerate and the yarn released from the bobbin is buffered by the buffer arm. The starting time can be synchronized so that the weaving machine starts to consume yarn when the buffer arm has stored its maximum length or near the maximum length such as 90% or more of the maximum length. The bobbin has then already reached a certain speed at insertion start and do not have to accelerate so fast to reach the required speed to output the average amount of yarn per cycle consumed by the weaving machine. The second insertion can in accordance with some embodiments be partly taken from the buffer and finally the bobbin has reached its predetermined speed, i.e. the speed that unroll the average amount (length) of yarn per machine cycle consumed by weaving machine. The start in advance information can come from monitoring the weaving machine encoder, or via a special start in advance signal from the weaving machine.

3. An even lower acceleration demand can be achieved if the weaving machine is controlled to start slowly and the weaving machine is controlled to ramp up its speed. This speed ramp can typically start from zero and successively increase the machine speed. The increase in speed can be controlled to be linear, in steps or in accordance with some pre-determined speed increase curve. Some woven articles show a different weaving result of the ready cloth, for instance a different aspect of the cloth, depending on the speed it is woven at. The biggest differences are often seen at low speeds. In this case it might be advantageous to start the machine fast, for instance to ½ of its production speed in one step, and then ramp up to the production speed in smaller steps or following a pre-determined speed increase curve until full production speed is reached for the weaving machine. Of course, any other first speed step followed by other steps or speed curve might be used. For some woven articles it is necessary to immediately go to the production speed and in this case start procedure 1 or 2 can be used.

The above described start procedures can of cause be used not only for limiting the acceleration of the bobbin, but instead to reach a higher speed of the weaving machine.

Stop of Machine

The stop of the weaving can also be limited in a corresponding manner as start of a weaving machine can be limited as described above. To stop the rotation of a bobbin with a big mass of inertia typically takes a certain time to not overload the motor and control system, and to not damage the bobbin.

In accordance with one exemplary embodiment, a controlled stop, for example if the operator pushes the stop button, a ramp down sequence can be used. The stop sequence can be the start sequence in reverse. This ramp down speed curve and positioning of the buffer arm can advantageous be connected with weaving machine speed, speed ramp down, positions and other activities in the weaving machine.

The machine can stop at different positions and with different braking speeds, depending on the type of machine, the type of stop (filling, warp or hand stop) and starting mark settings (e.g. max allowed brake position). In some cases, the insertion will be cancelled to avoid a starting mark or even warp damage. Therefore, special stop procedures can be used to avoid yarn to be released from the yarn feeding arrangement and to maintain a minimum tension. It is typically important that the yarn feeding arrangement knows the position and can coordinate its activities with the actual machine position.

Weft Stops

In some other type of stops, for example if the rapier lose the yarn, or at a weft yarn break, the free end of the weft yarn will not anymore be connected to the weaving machine but instead be placed somewhere in the area between the weaving machine and the bobbin. At such a yarn break the yarn tension is lost, it goes down to zero or near zero. If the yarn tension decreases, the controller of the yarn feeding arrangement typically can be set to compensate this by rotating the bobbin slower and/or by moving the buffer arm backwards to stretch the yarn (increasing the buffer). As the end of the yarn is in free air, the yarn feeding arrangement will not succeed in increasing the yarn tension and a safety protocol can be used by the controller to prevent the system from acting in an undesired way. For example by moving the buffer arm excessively. The control system will also prevent these sensor data from entering the coming regulation system. Input from a yarn break shall not influence the feed forward control, the ILC or control model.

If communication is set up between the weaving machine and the yarn feeding arrangement, the weaving machine can be configured to send a stop signal to the yarn feeding arrangement informing that there has been a weft stop. The yarn feeding arrangement can then be configured to in response to such a stop signal stop the yarn feeding arrangement and not try to stretch the yarn. Correspondingly, if the yarn feeding arrangement detects a yarn break or other malfunction, it will send a stop signal to the weaving machine.

If there is no such communication or if a stop signal is not received for some reason, the yarn feeding arrangement can be configured to, upon detection of a sudden drop of weft tension, control the yarn feeding arrangement in response to such a detected sudden drop of weft tension. For example, the yarn feeding arrangement can be controlled to have a time out in the action to try to come back to the desired yarn tension. In another embodiment, if the tension drops to zero, or to a significantly lower level at a predetermined time or at a pre-determined weaving machine angle the controller can be configured to determine that a weft stop has occurred and that a stop should be initiated. Another way to detect a machine stop is to detect a sudden drop of the weaving machine speed by reading the master encoder of the weaving machine.

Thread Up of System

If the weaving machine stops due to a warp problem or any other kind of stop where the weft yarn is still connected to the left side of the weaving machine, the yarn feeding arrangement is already threaded up. To prepare for the coming start the yarn feeding arrangement can be configured to place the motor driven buffer arm in a start position and the bobbin will be rotated so that the yarn is all the time under a certain, predetermined, tension. The yarn tension sensor will provide the controller with information so this predetermined tension can be kept during the whole preparation for start cycle.

At a typical preparation after a weft stop where the free end of the weft yarn is not connected to the weaving machine, an operator needs to rethread the yarn and connect it to the weaving machine. For example, in a rapier weaving machine, to a position where the rapier will catch the yarn when the machine starts again. After threading the yarn, the operator can inform the controller that the yarn feeding arrangement is threaded and the control system will then stretch up the yarn and place the buffer arm in start position. This information can be provided to the controller in different ways, for example with a push button.

In accordance with one embodiment, the buffer arm when in stop state can be positioned in a start position and the bobbin is rotated and give the desired amount of yarn based on information from the yarn tension sensor. In that case the bobbin will always keep the yarn stretched. When an operator pulls the yarn manually the bobbin will rotate to supply yarn to the threading operation, and if the operator releases yarn after fastening the yarn end in the weaving machine, the bobbin will rotate backwards to keep the yarn under tension. These procedures can be coordinated with controlled brakes that can be controlled to hold or nip the yarn in place at certain times to facilitate the threading operation. The here mentioned brake can also be used during weaving in order to nip the yarn, or lock the yarn, so at for example at the end of insertion, the yarn feeding arrangement cannot deliver more yarn. This to ensure that the yarn released from e.g. a receiving rapier always gives the same length or as similar length as possible from pick to pick of yarn.

In accordance with another embodiment the yarn feeding arrangement will be set in safe mode and the bobbin drive and buffer arm drive will be prevented from movement or applying any torque, alternatively, a holding torque is applied to keep the bobbin and buffer arm in fixed positions and prevent any movement when an operator is in a defined safety zone. The safety zone can be an zone close to the yarn feeding arrangement. The safety zone can be physically delimited by a door or similar or a virtual zone where sensors detect the presence of an operator close to the yarn feeding arrangement. In accordance with one embodiment, the safe mode can allow running of the yarn feeding arrangement at a very low speed even when an operator is present in the safety zone.

Bobbin Change—End of Bobbin

When changing bobbin in a conventional weaving system, the end tail of a bobbin is typically connected (e.g. by a knot) to the beginning of the bobbin to be used next. By constantly replacing the empty bobbin with a new and connect the full bobbin to the end of the bobbin in work the weaving machine can continue to run also at bobbin switch.

In a zero twist system, the bobbin rotates and thus makes it impossible to use the conventional weaving system. In a zero twist system, at least the yarn feeding arrangement for the channel in question has to be stopped, and in most cases also the weaving machine has to be stopped. The bobbin will then be replaced and the yarn from the new bobbin must be connected to the insertion system in the weaving machine. This can be done in several ways.

A) In one embodiment, the complete system is threaded up from bobbin, through the buffer arm, the sensor arm, and if mounted, yarn brakes and other accessories, and finally in to the insertion entrance of the weaving machine.

B) In another embodiment, the end of the new bobbin is connected to the end of the yarn that is already threaded in the yarn feeding arrangement. This connection can be made by knotting, splicing, tape or other methods. The connection point is in most cases not allowed in the woven cloth and it has to be removed before starting to weave again. This can be done by manually or automatically drawn the yarn through the yarn feeding arrangement until the connection point comes out before the insertion entrance and can be removed. The operator can in some embodiments check and if needed adjust the tape so it is not twisted in the system before start.

To enable embodiment B), the weaving machine typically has to be stopped before the bobbin is finished and the tail goes in to the yarn feeding arrangement system, or in to the weaving machine. Also, for reasons of quality of the ready cloth, the yarn tail should preferably not pass in to the weaving machine. One way to stop the weaving process before the bobbin is finished is to have a sensor that supervise the bobbin and detects when the bobbin is nearly finished. An example of such a sensor might be an optical sensor that looks at the bobbin and detects the difference in reflection between the yarn and the bobbin center. As bobbin center a tube of paper, plastic or metal is often used. This has normally other optical properties than the yarn that is wound on the bobbin center. An optical sensor will then detect the difference in optical properties when the bobbin center starts to show between the last windings of yarn on the bobbin. Based on the reading of the optical sensor the weaving machine can be stopped before the bobbin is finished.

Other ways of detecting the end of bobbin in advance are also envisaged, for example sensors measuring the diameter of the bobbin. Such sensors can be optical or mechanical. In accordance with one embodiment, the bobbin can be provided with the length of yarn stored on the bobbin and this information can be given to the controller. The controller can then be programmed to count the length of yarn fed to the weaving machine and determine when the yarn on the bobbin is near the end to be when the weaving machine has consumed (almost) the amount of yarn given from the bobbin.

Thus, the rotating bobbin can be measured to detect the end of the bobbin in advance.

There is a maximum speed a bobbin can be rotated at before the yarn layers in the bobbin collapses by the centrifugal forces and the yarn is thrown out and messes up. This will result in a yarn tangle and the yarn feed typically needs to be stopped. To reach high weaving machine speeds, two or more yarn feeding arrangements as described above can be used, or a two or more channel yarn feeding arrangement can be used. Such a yarn feeding arrangement can comprise two bobbins, two buffer arms and two sensors. The weaving machine runs a pattern called weft mix, or pick a pick. That is, channel one makes one insertion followed by an insertion from channel 2 and then again channel 1 etc. Hereby the maximum weaving machine speed can be increased without a risk for a yarn tangle at the bobbin.

A two or more channel system can be optimized and contain common parts such as a common central unit for all channels, a common frame and common I/O.

To synchronize the yarn feeding arrangements with the weaving machine, a signal representing the channel pattern can be given to the yarn feeing arrangement. This signal can for example be a signal that tells which channel that shall be inserted next.

It is important to have this information for running the system and inserting the right channel, but also to perform a learning cycle, for start of weaving, for pick finding and for various weft repair and preparation procedures. This information can be obtained from the weaving machine control system or from separately mounted sensors.

The invention claimed is:

1. A yarn feeding arrangement for feeding weft yarn to a weaving machine, the yarn feeding arrangement comprising:

a motor driven bobbin drive and a motor driven loop buffer device, a sensor configured to detect yarn motion, a controller for controlling a motor of the motor driven bobbin drive and the motor driven loop buffer device, wherein the controller is adapted to:

drive the motor of the motor driven bobbin drive at a speed to feed a determined average amount of weft yarn to be consumed by the weaving machine, drive the motor of the motor driven loop buffer device based on the difference between the output yarn motion from the motor driven bobbin drive and a motion model of weft insertion yarn motion in the weaving machine, wherein the controller is adapted to determine the motion model based on a learning procedure, and wherein the learning procedure is configured to operate at least one of the motor driven bobbin drive and the motor driven loop buffer device.

2. The yarn feeding arrangement according to claim 1, wherein the yarn feeding arrangement is configured to perform the learning procedure before starting to weave a new article or after change of bobbin.

3. The yarn feeding arrangement according to claim 1, wherein the controller is adapted to during the learning procedure determine the amount of yarn per revolution unrolled from the bobbin.

4. The yarn feeding arrangement according to claim 1, wherein the yarn feeding arrangement is configured to during the learning procedure receive data when the weaving machine is run in a slow-motion speed, the slow-motion speed being lower than normal speed of operation of the weaving machine.

5. The yarn feeding arrangement according to claim 4, wherein the motor of the motor driven bobbin drive is in a stationary mode during at least a period of time when the weaving machine is run in the slow-motion speed.

6. The yarn feeding arrangement according to claim 1, wherein the learning procedure comprises at least one complete weaving machine cycle.

7. The yarn feeding arrangement according to claim 1, wherein the controller is configured to determine a gear ratio between a drive of the motor driven bobbin and the weaving machine during the learning procedure.

8. The yarn feeding arrangement according to claim 1, wherein the motor of the motor driven bobbin drive is adapted to unroll weft yarn from the bobbin using a center drive mechanism.

9. The yarn feeding arrangement according to claim 1, wherein the sensor comprises a sensor arm, the sensor arm having an equivalent mass of less than 10 grams.

10. The yarn feeding arrangement according to claim 1, wherein the yarn feeding arrangement is configured to use the model obtained by the learning procedure at start of a weaving process and wherein a buffer arm is in a position where the maximum length of yarn is stored.

11. The yarn feeding arrangement according to claim 1, wherein the yarn feeding arrangement is configured to use the model obtained by the learning procedure at start of a weaving process and wherein the buffer arm is in a position where the minimum length of yarn is stored, wherein the yarn feeding arrangement is configured to receive a start in advance signal from the weaving machine and wherein the yarn feeding arrangement is configured to start to accelerate the bobbin and take up the yarn with a buffer arm upon reception of such a start in advance signal.

12. The yarn feeding arrangement according to claim 1, wherein the yarn feeding arrangement is configured to use the model obtained by the learning procedure at start of a weaving process in a speed ramp up sequence.

13. The yarn feeding arrangement according to claim 1, wherein the yarn feeding arrangement is configured to use the model obtained by the learning procedure at start of a weaving process after a switch from empty to full bobbin.

14. The yarn feeding arrangement according to claim 1, wherein the yarn feeding arrangement is configured to perform a feed forward control of the yarn feeing arrangement based on the motion model determined based on the learning procedure.

15. The yarn feeding arrangement according to claim 1, wherein the yarn feeding arrangement is configured to drive one or more of: the motor of the motor driven bobbin drive and the motor driven loop buffer device during the learning procedure.

16. The yarn feeding arrangement according to claim 1, wherein the sensor comprises a sensor arm, the sensor arm having an equivalent mass in the range of 1-4 grams.

* * * * *